US011499702B1

(12) United States Patent
Suslow et al.

(10) Patent No.: US 11,499,702 B1
(45) Date of Patent: Nov. 15, 2022

(54) FLUSH MOUNT LED BOLTS

(71) Applicant: Oznium LLC, Pagosa Springs, CO (US)

(72) Inventors: Philip Parker Suslow, Pagosa Springs, CO (US); Ka Lun Gallant Man, Yorba Linda, CA (US)

(73) Assignee: Oznium, Pagosa Springs, CO (US)

( * ) Notice: Subject to any disclaimer, the term of this patent is extended or adjusted under 35 U.S.C. 154(b) by 0 days.

(21) Appl. No.: 17/484,694

(22) Filed: Sep. 24, 2021

Related U.S. Application Data

(63) Continuation-in-part of application No. 29/802,407, filed on Aug. 5, 2021.

(51) Int. Cl.
*F21V 19/00* (2006.01)
*F21V 23/00* (2015.01)
*F21Y 115/10* (2016.01)

(52) U.S. Cl.
CPC ..... *F21V 19/0055* (2013.01); *F21V 23/001* (2013.01); *F21Y 2115/10* (2016.08)

(58) Field of Classification Search
CPC ..... F21V 19/0055; F21V 23/001
See application file for complete search history.

(56) References Cited

U.S. PATENT DOCUMENTS 7,771,085 B2 * 8/2010 Kim ..... H05B 45/357 362/285
8,608,366 B2 * 12/2013 Wang ..... F21K 9/23 362/650
9,052,101 B1 * 6/2015 Kathawate ..... F21S 8/024
9,157,581 B2 * 10/2015 Boomgaarden ..... G02B 6/0031
9,702,516 B1 * 7/2017 Vasquez ..... F21V 17/166
10,047,922 B2 * 8/2018 Chien ..... F21S 10/02
10,508,783 B2 * 12/2019 Lawrence ..... F21V 23/008
11,002,433 B2 * 5/2021 Ninomiya ..... F21S 8/03
2002/0075679 A1 * 6/2002 Machi ..... F21V 19/04 362/231
2015/0211699 A1 * 7/2015 McMillan ..... F21S 8/026 362/147

FOREIGN PATENT DOCUMENTS

CN 108870221 A * 11/2018
WO WO-2020104791 A1 * 5/2020 ..... F21S 8/026

OTHER PUBLICATIONS

English translation of Jia CN-108870221-A, published Nov. 2018 (Year: 2018).*

* cited by examiner

*Primary Examiner* — Evan P Dzierzynski
(74) *Attorney, Agent, or Firm* — Christopher Pilling

(57) ABSTRACT

A flush mount LED bolt providing has a cylindrical housing having a first end and a second end, the cylindrical housing includes a housing diameter and a housing length, and wherein at least a portion of the cylindrical housing includes threads. A bezel is positioned at the first end of the cylindrical housing. The bezel includes a top surface and a rear surface. The bezel's shape and design may vary. An LED light is provided. The LED light may vary in color, brightness, etc. depending on the desired application. During installation, the cylindrical housing is configured to be inserted through a mounting hole on a mounting surface and the rear surface of the bezel is configured to mounted flush with the mounting surface creating a low profile installed LED bolt with only the bezel visible.

15 Claims, 6 Drawing Sheets

FLUSH MOUNT LED BOLTS

CROSS-REFERENCE TO RELATED APPLICATIONS

The present application is a continuation in part application to design Patent Application Ser. No. 29/802,407, filed on Aug. 5, 2021, the disclosure of which is hereby incorporated in its entirety at least by reference.

BACKGROUND OF THE INVENTION

1. Field of the Invention

The present invention generally relates to lighting equipment but more particularly to flush mount LED bolts.

2. Description of Related Art

Light-emitting diodes (LEDs) are a useful light source suitable in a variety of applications. Some applications include automotive applications and marine vessels as well as residential and commercial applications for indoor and outdoor lighting. The advantages of LEDs are well known, including lower power consumption, long life cycles, and their small size compared to incandescent light sources. Utilizing these properties an innovative product is described herein.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A flush mount LED bolt is provided, comprising a cylindrical housing having a first end and a second end, the cylindrical housing includes a housing diameter and a housing length, and wherein at least a portion of the cylindrical housing includes threads; a bezel positioned at the first end of the cylindrical housing, wherein the bezel includes a top surface and a rear surface, wherein the distance between the top surface defines a bezel length; an LED light; and, wherein during installation the cylindrical housing is configured to be inserted through a mounting hole on a mounting surface and the rear surface of the bezel is configured to mounted flush with the mounting surface creating a low profile installed LED bolt with only the bezel visible.

In one embodiment, at least one screw nut configured to be threaded on the threads of the cylindrical housing is provided such that the flush mount LED bolt is retained when installed. In one embodiment, a LED lens positioned centrally within the bezel is provided, wherein the LED lens is flat or domed shaped. In another embodiment, the bezel is a circular disk having a bezel diameter, wherein the bezel diameter is larger than the housing diameter. In one embodiment, the housing length is larger than the bezel length. In another embodiment, the bezel includes holes enabling front installation via a specialized tool. In yet another embodiment, a retaining spring enabling front installation is provided. In one embodiment, the housing includes slots configured to retain a pair of retaining arms of the retaining spring. In one embodiment, the bezel is comprised of a shape of at least one of: square, rectangle, circle, triangle, pentagon, hexagon, diamond, oval, trapezoid, polygon, or irregular shaped polygon. In one embodiment, a cap integrated or attached to the bezel configured to affect the LED light. In another embodiment, wherein the cap is one of a grill, blinds, bi-directional, or one directional arrangement. In one embodiment, the bezel length is between 0.1 mm to 50 mm. In another embodiment, the bezel length is approximately 1 to 2 mm. In one embodiment, the housing length is approximately 15-20 mm. In another embodiment, the housing diameter is approximately 11 mm and the bezel diameter is approximately 15 mm.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide flush mount LED bolts.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Figure 1:
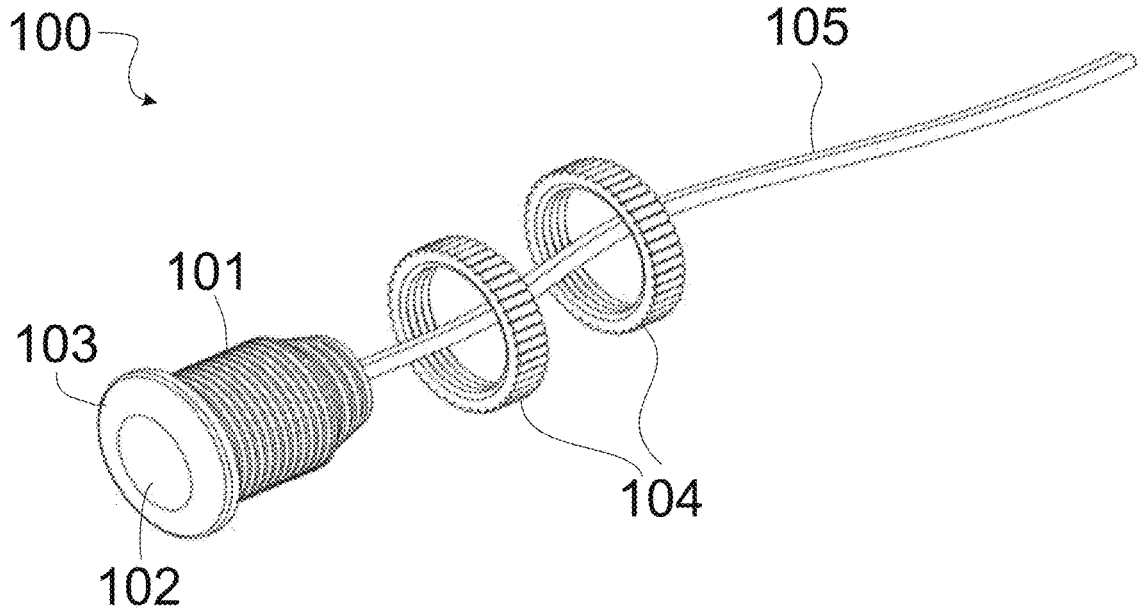
FIG. 1 is a perspective view of a flush mount LED bolt according to an embodiment of the present invention.
Figure 2:
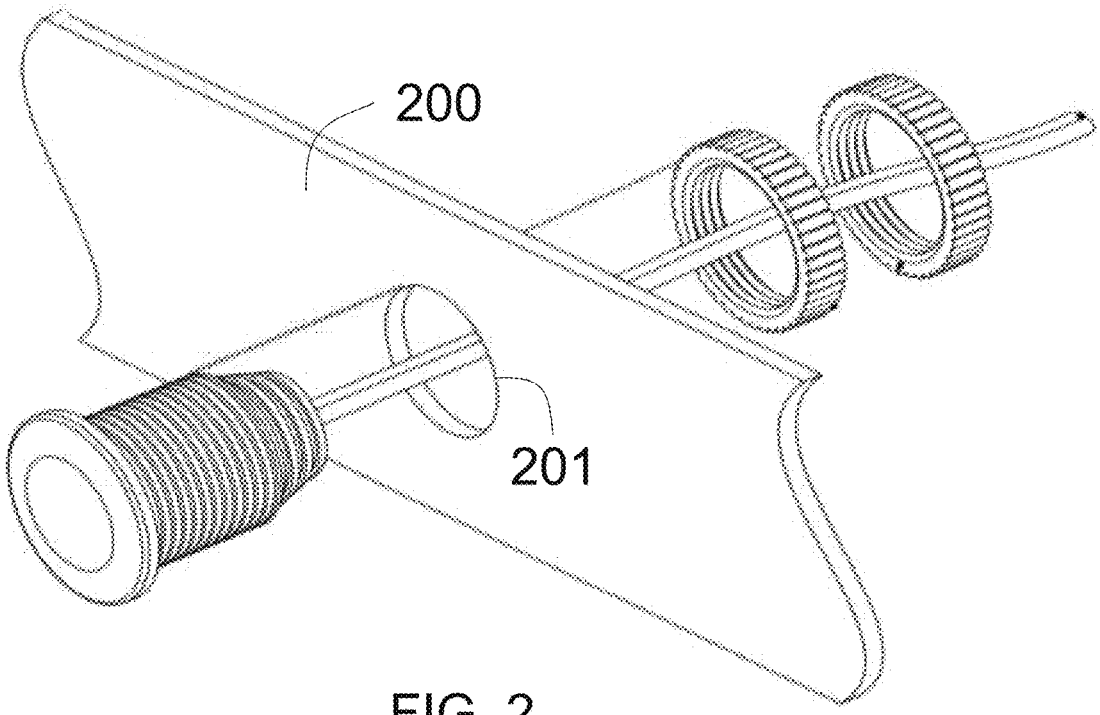
FIG. 2 is an exploded perspective view of the flush mount LED bolt of FIG. 1 installed in an application according to an embodiment of the present invention.
Figure 3:
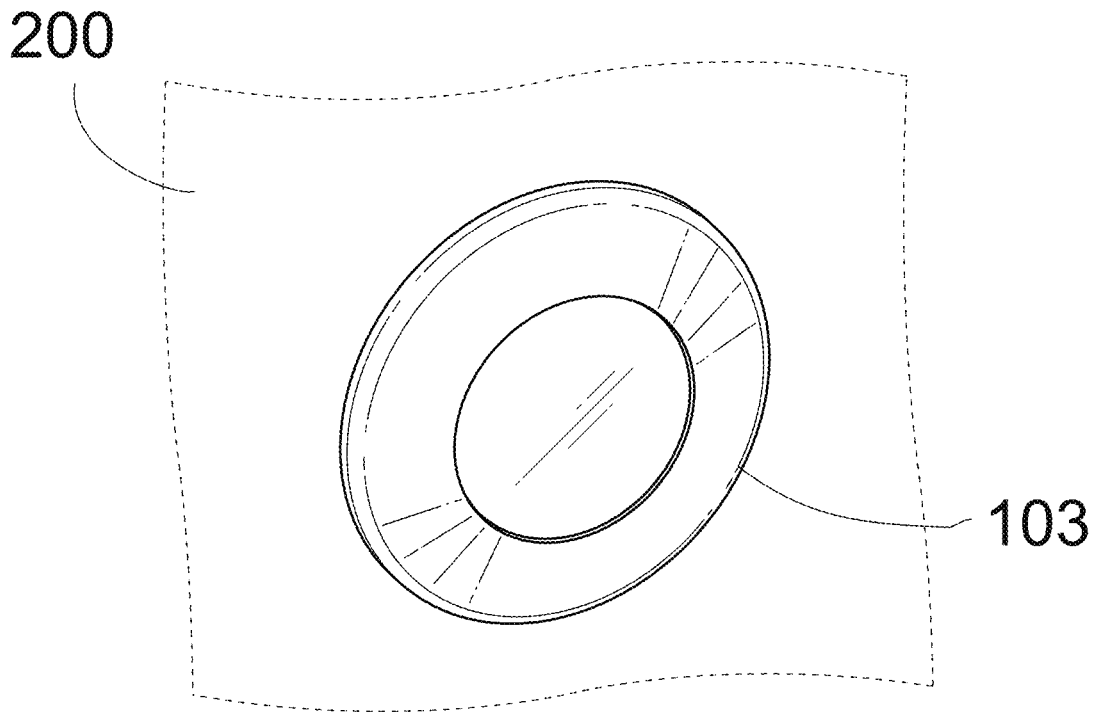
FIG. 3 is a perspective view of a flush mount LED bolt installed in an application according to an embodiment of the present invention.

FIGS. 1-3 are various views of a flush mount LED bolt according to an embodiment of the present invention. Referring now to FIGS. 1-3, the flush mount LED bolt 100 is illustrated. In some embodiments, the flush mount LED bolt comprises a housing 101, LED light 102, bezel 103, mounting nuts 104, and electrical wires 105. In one embodiment, the housing 101 is cylindrically shaped, like a bolt, and comprises male threads positioned on the outside surface of the cylindrically shaped housing. In some embodiments, the housing 101 may be tapered at an end portion or be of a single diameter throughout the length of the housing. The electrical wires supply power to the LED light 102 from a power source (not shown) as well known in the art. In one embodiment, the LED light 102 is covered with a thin flat lens flush with the bezel. In alternative embodiments, the lens may be dome shaped. In some embodiments, no lens is provided. The lens can be comprised of any color, transparency, or finish. In some embodiments, the material of the lens may be an epoxy lens, polycarbonate (PC) lens, or polymethyl methacrylate (PMMA) lens. The LED light may be of any wattage and brightness necessary for the application. In one embodiment, the LED light may have wattage between 0.01 W to 100 W. In one embodiment, the brightness between 0.01 lumens to 10,000 lumens. The LED light may be of any color, or be a combination of 2 or more colors. In some embodiments, the LED light is an ultraviolet (UV) light. In other embodiments, the LED light is an infrared light. It should be understood that the color temperature of the LED light or the color rendering index (CRI) may vary.

The housing 101 is sized and shaped to fit through a mounting hole 201 on a mounting location 200. In some embodiments, the housing 101 may be constructed of metal or plastic. In some embodiments, the housing 101 may include a surface finish, including but not limited to, painting, die casting, anodizing, powder coating, bead blasting, as machined from the CNC machine or other creation process (injection molding, 3D printed, etc.), or any other known finishes. In one embodiment, the bezel 103 is shaped like a thin disk, which advantageously enables the bezel to fit flush against the mounting surface 200 providing a low profile design. In one embodiment, the thickness of the bezel 103 may be any thickness between 0.1 mm to 50 mm. In another embodiment, the thickness of the bezel 103 is approximately 1-2 mm. In some embodiments, the housing is approximately 15-20 mm in length. In one embodiment, the diameter of the housing 101 is approximately 11 mm, such that a M11 drill bit may be used to create the mounting hole 201 through the mounting surface 200. In one embodiment, the diameter of the bezel 103 is approximately 15 mm. However, it is understood that the sizes and diameters of the housing and bezel may vary from 1 mm to 100 mm, with the bezel having a larger diameter than the bezel as illustrated.

In one embodiment, during installation the treaded housing 101 is positioned through the mounting hole 201 until the bezel 103 is flush against the mounting surface, and more particularly a rear surface of the bezel 103 is flush with the mounting surface. Next, a screw nut 104 is threaded onto the housing until it abuts the rear surface of the mounting surface 201 securing the flush mount LED bolt 100 in a fixed position. In some embodiments, an additional screw nut 104 is used to prevent the first screw nut 104 from backing out during use, as the flush mount LED bolt 100 is often in applications in which the flush mount LED bolt 100 is subjected to motion and vibration. Typical applications included automotive or marine vehicles. It should be understood, that other applications are possible, including but not limited to commercial, residential applications.

FIGS. 4A-D are various views of different embodiments of flush mount LED bolts.

Figure 4A:
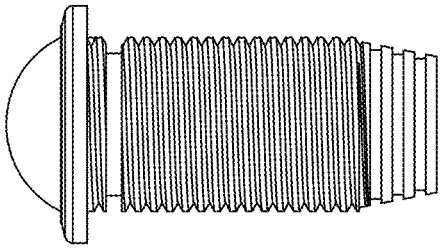
FIGS. 4A-D are various views of different embodiments of flush mount LED bolts.
Figure 4B:
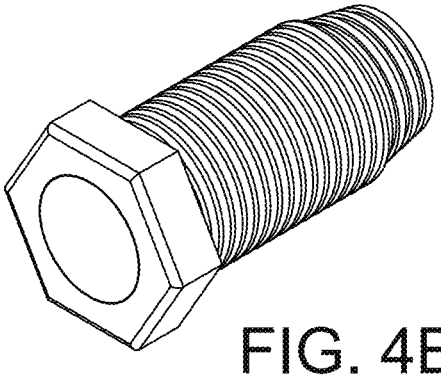
Figure 4C:
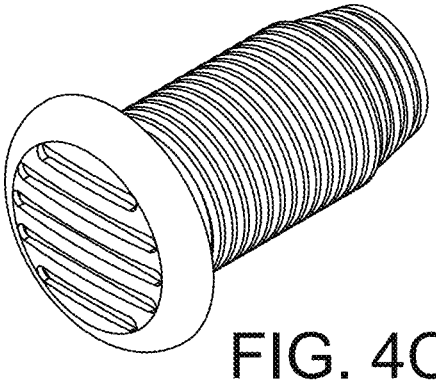
Figure 4D:
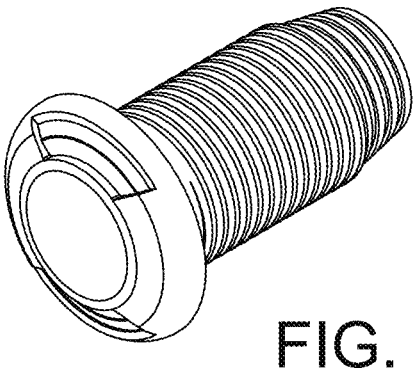

Referring now to FIGS. 4A-D, the shape of the bezel and/or LED light/lens may vary. For example, the bezel may be a square, rectangle, circle, triangle, pentagon, hexagon, diamond, oval, trapezoid, polygon, irregular shaped polygon, or any other shape. In some embodiments, the LED light lens is flush with the bezel. In other embodiments, the lens of the LED light may be an additional shape, such as recessed from the bezel, or bulbous (such as illustrated in FIG. 4A). Further, in some embodiments, a cap may be provided to affect the light as it passes through the lens, such as a grill, blinds, bi-directional, or one directional. The cap may be integrated with the bezel or may be an additional cap that fits on and over the bezel.

Figure 4E:
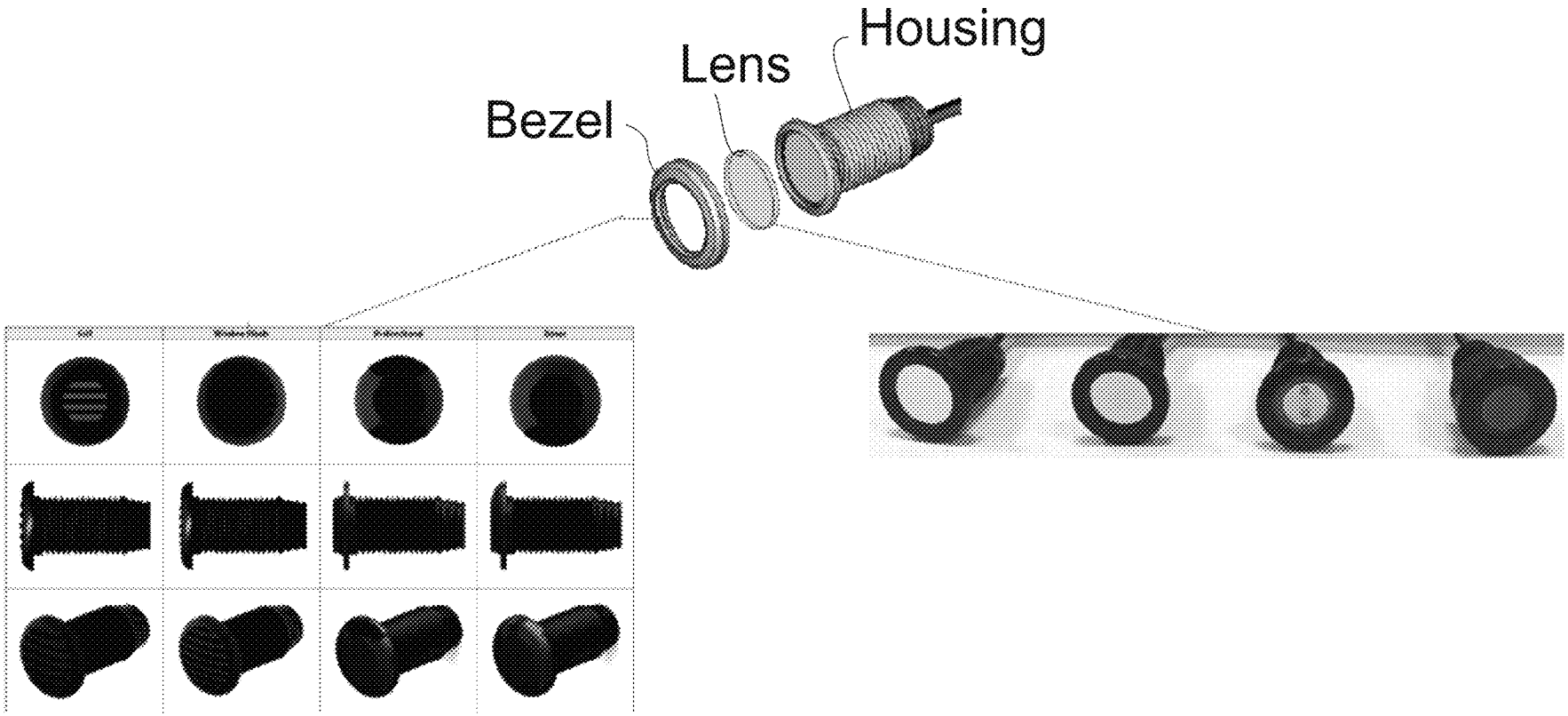
FIG. 4E illustrates an some examples of possible bezel and lens combinations for a flush mount LED bolt according to an embodiment of the present invention.

FIG. 4E illustrates some examples of possible bezel and lens combinations for a flush mount LED bolt. Referring now to FIG. 4E, many combinations are possible, wherein the bezel may include a cap as previously mentioned, affecting the light transmission through the end of the LED bolt, including but not limited to grill, blinds, bi-directional, and one directional (down or up). Likewise, the lens can be switched independently from the bezel cap, wherein the lens' type, color, and shape may vary as previously discussed.

Figure 7A:
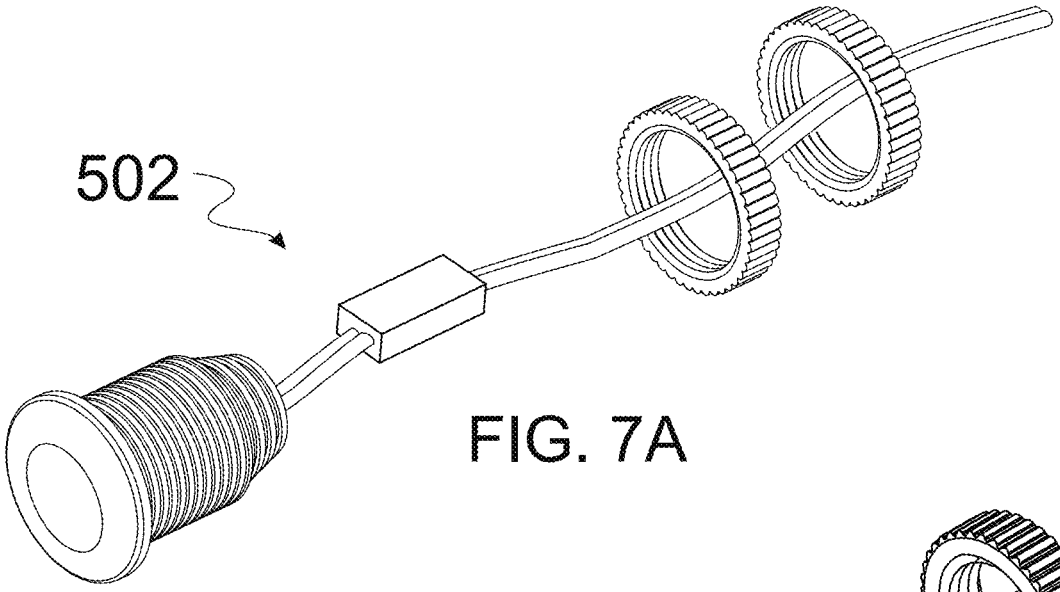
FIG. 7A is a perspective view of a flush mount LED bolt with external circuitry according to an embodiment of the present invention.
Figure 7B:
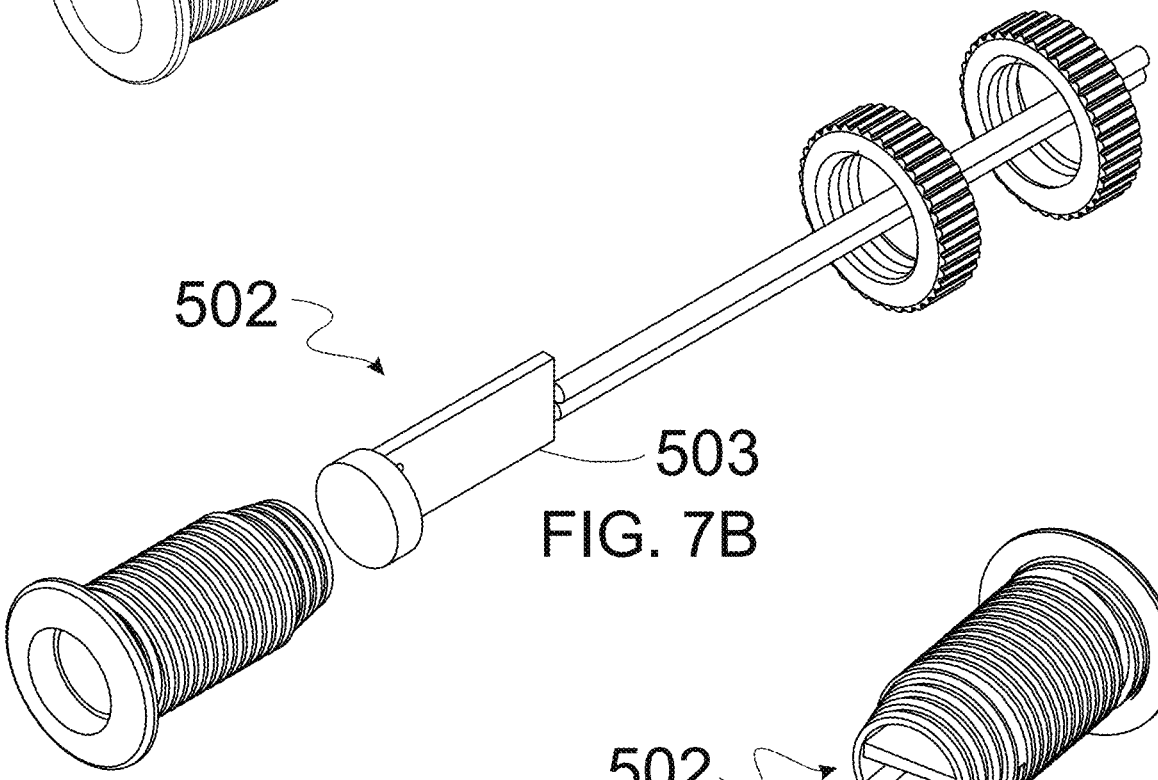
FIG. 7B is an exploded perspective view of a flush mount LED bolt showing the built-in circuitry according to an embodiment of the present invention.
Figure 7C:
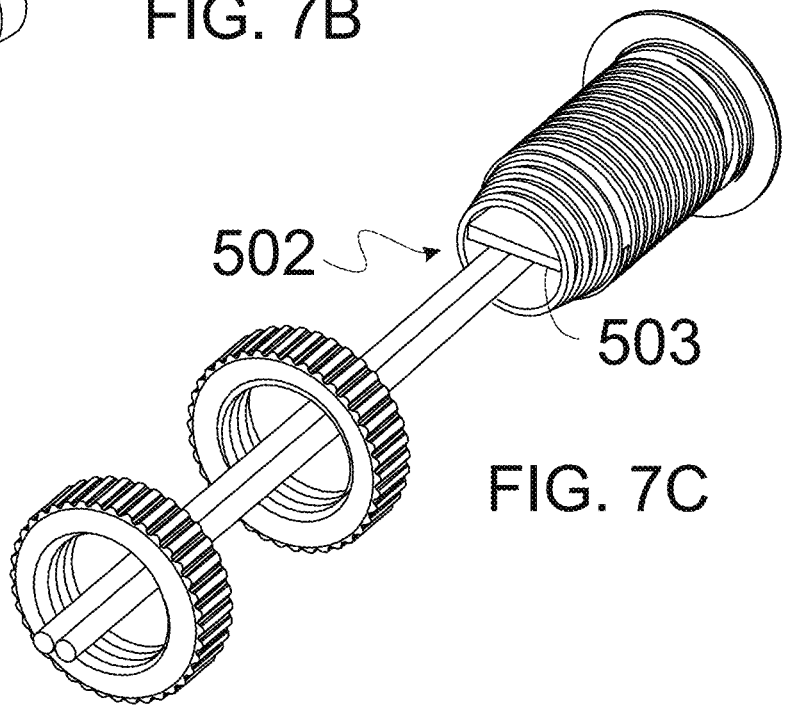
FIG. 7C is a perspective view of a flush mount LED bolt showing the built-in circuitry according to an embodiment of the present invention.

In some embodiments, custom circuitry is provided, wherein the circuitry is built-in circuitry 501 (FIGS. 7B-C) or external 502 (FIG. 7A) circuitry. The circuitry is configured to perform various lighting functions, including but not limited to, dual colors, multiple colors, switching between multiple colors, dual brightness, and various brightness settings. Further, the circuitry may include various sensors, such as a motion sensor switch and/or a light sensor switch. Other switches may be provided, such as a touch switch and/or a touchless switch. In some embodiments, the circuitry may vary the supply voltage via one or more transformers, wherein in other embodiments, the voltage is constant. Likewise, the current may be constant, adjusted, or varied via one or more resisters. In one embodiment, the circuitry is provided on a PCB 503 (FIGS. 7B-C). In some embodiments, epoxy is used to seal in the circuitry for the built-in circuitry.

Figure 5A:
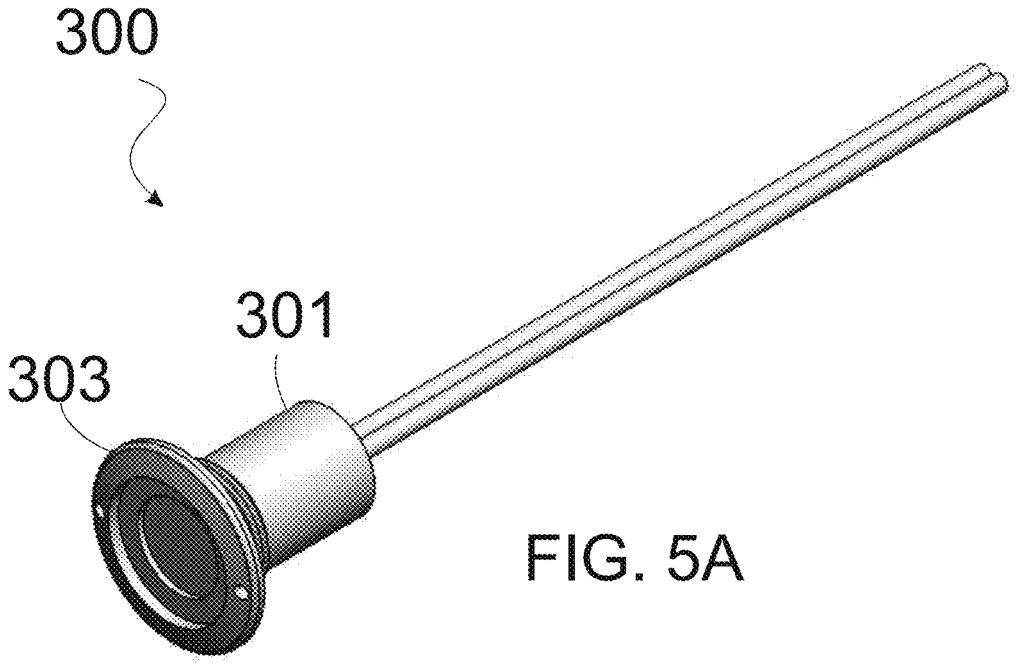
FIG. 5A is a perspective view of a flush mount LED bolt with an alternative bezel according to an embodiment of the present invention.
Figure 5B:
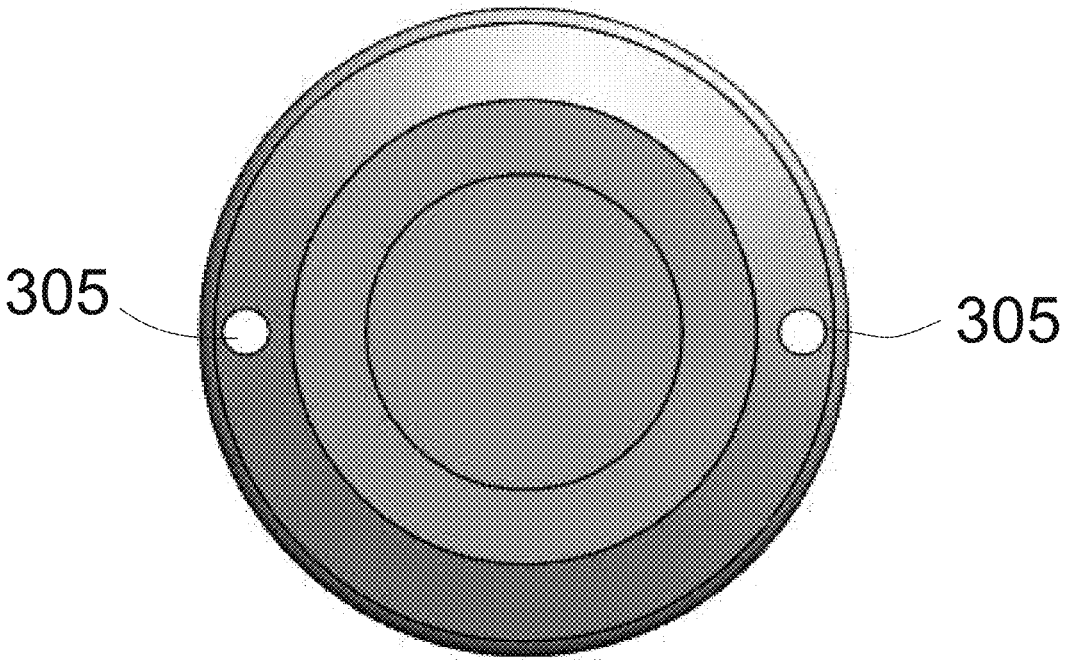
FIG. 5B is a top view of the alternative bezel of FIG. 5A.

FIGS. 5A-B are various view of a flush mount LED bolt with an alternative bezel according to an embodiment of the present invention. Referring now to FIGS. 5A-B, the flush mount LED bolt 300 with an alternative bezel 303 and housing 301 is illustrated. In some embodiments, it is not possible to use screw nuts as disclosed above for installing the flush mount LED bolt due to the mounting location and access to the rear of the bolt. In one embodiment, a pair of small holes 305 are provided on opposite ends of the top surface of the bezel 301, wherein the holes enable the flush mount LED bolt 300 to be tightened using a special application tool (Not illustrated). In another embodiment, a retaining spring may be used, which will be discussed in further details below.

Figure 6A:
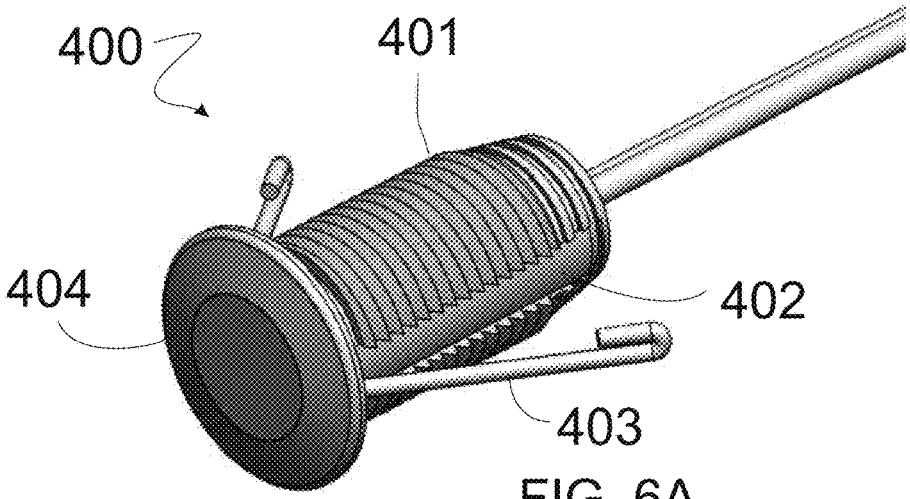
FIGS. 6A-E are various view of an alternative installation method for a flush mount LED bolt according to an embodiment of the present invention.
Figure 6B:
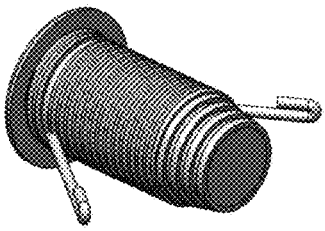
Figure 6C:
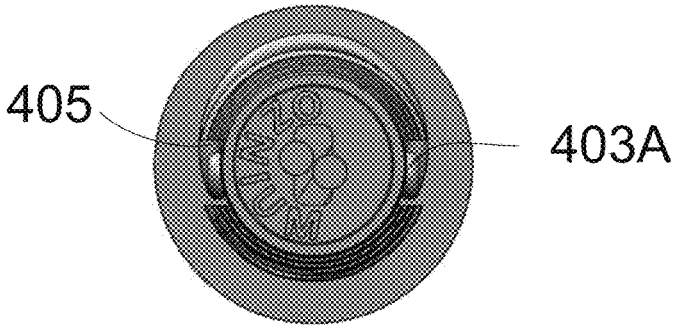
Figure 6D:
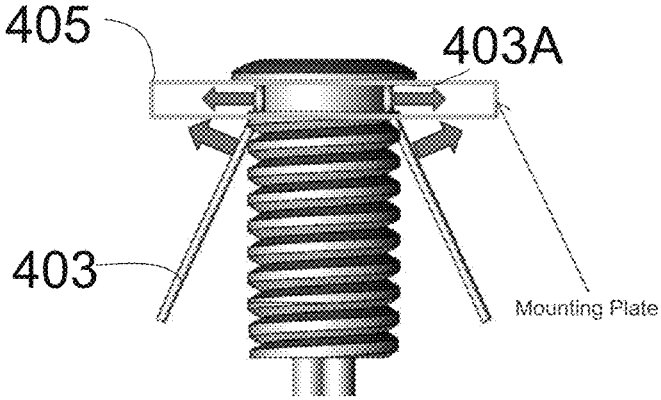
Figure 6E:
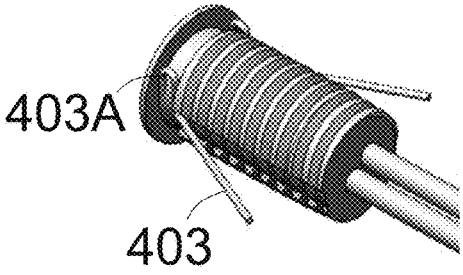

FIGS. 6A-D are various view of an alternative installation method for a flush mount LED bolt according to an embodiment of the present invention. Referring now to FIGS. 6A-D, a flush mount LED bolt 400 with retaining spring 403A is illustrated. In one embodiment, the flush mount LED bolt 400 with retaining spring 403A comprises a housing 401 and flush mounted bezel 404, wherein the housing 401 includes a slot 402 configured to fit a retaining arm 403 of the retaining spring within prior to installation. In some embodiments, a slot 402 may be provided on both sides of the housing 401 such that both arms of the retaining spring 403 may fit in the slots. In other embodiments, no slots are provided on the housing 101 (as seen in FIG. 6B). In the embodiments with the slot, the snap-fit retaining arm is configured to be hidden in the slot when the user presses the arm before the flush mount LED bolt is positioned in the mounting hole (not illustrated), wherein the snap-fit retaining arms 403 expand against the rear surface of the mounting surface/plate retaining the flush mount LED bolt in an installed position. Advantageously, the special application tool or retaining spring offers an alternative to the screw nuts when front installation is required.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A flush mount LED bolt comprising:

a cylindrical housing having a first end and a second end, the cylindrical housing includes a housing diameter and a housing length, and wherein at least a portion of the cylindrical housing includes threads;

a retaining spring with a pair of spring arms, wherein the cylindrical housing includes a pair of slots extending lengthwise on opposite sides of the cylindrical housing, the pair of spring arms configured to be hidden within the pair of slots prior to installation;

a bezel positioned at the first end of the cylindrical housing, wherein the bezel includes a top surface and a rear surface, wherein the distance between the top surface defines a bezel length;

an LED light;

a power source configured to supply power to the LED light via electrical wires; and, wherein during installation the cylindrical housing with the pair of spring arms hidden within the pair of slots is configured to be inserted through a mounting hole on a mounting surface and the rear surface of the bezel is configured to mounted flush with the mounting surface, wherein the pair of spring arms are configured to expand perpendicularly from the pair of slots such that the pair of spring arms are engaged perpendicularly against a rear surface of the mounting surface securing the flush mount LED bolt in position and creating a low profile installed LED bolt with only the bezel visible.

2. The flush mount LED bolt of claim 1, further comprising at least one screw nut configured to be threaded on the threads of the cylindrical housing such that the flush mount LED bolt is retained when installed.

3. The flush mount LED bolt of claim 1, further comprising a LED lens positioned centrally within the bezel, wherein the LED lens is flat or domed shaped.

4. The flush mount LED bolt of claim 1, wherein the bezel is a circular disk having a bezel diameter, wherein the bezel diameter is larger than the housing diameter.

5. The flush mount LED bolt of claim 1, wherein the housing length is larger than the bezel length.

6. The flush mount LED bolt of claim 1, wherein the retaining spring enabling front installation.

7. The flush mount LED bolt of claim 1, wherein the bezel is comprised of a shape of at least one of: square, rectangle, circle, triangle, pentagon, hexagon, diamond, oval, trapezoid, polygon, or irregular shaped polygon.

8. The flush mount LED bolt of claim 1, further comprising a cap integrated or attached to the bezel configured to affect the LED light.

9. The flush mount LED bolt of claim 8, wherein the cap is one of a grill, blinds, bi-directional, or one directional arrangement.

10. The flush mount LED bolt of claim 1, wherein the bezel length is between 0.1 mm to 50 mm.

11. The flush mount LED bolt of claim 1, wherein the bezel length is approximately 1 to 2 mm.

12. The flush mount LED bolt of claim 1, wherein the housing length is 1 to 100 mm.

13. The flush mount LED bolt of claim 1, further comprising built-in circuitry extending vertically within the cylindrical housing, the built-in circuitry configured to perform lighting functions essentially consisting of: dual colors, multiple colors, switching between multiple colors, dual brightness, and brightness settings.

14. The flush mount LED bolt of claim 13, wherein the built-in circuitry comprises a motion sensor or a light sensor switch.

15. The flush mount LED bolt of claim 1, further comprising external circuitry positioned along the electrical wires outside of the cylindrical housing, the external circuitry configured to perform lighting functions essentially consisting of: dual colors, multiple colors, switching between multiple colors, dual brightness, and brightness settings.

* * * * *